US008597049B2

(12) United States Patent
von zur Muehlen

(10) Patent No.: US 8,597,049 B2
(45) Date of Patent: Dec. 3, 2013

(54) MODULAR OPEN FUSE HOLDER

(75) Inventor: Patrick A. von zur Muehlen, Wildwood, MO (US)

(73) Assignee: Cooper Technologies Company, Houston, TX (US)

( * ) Notice: Subject to any disclaimer, the term of this patent is extended or adjusted under 35 U.S.C. 154(b) by 37 days.

(21) Appl. No.: 13/185,617

(22) Filed: Jul. 19, 2011

(65) Prior Publication Data

US 2013/0023150 A1 Jan. 24, 2013

(51) Int. Cl.
*H01R 13/66* (2006.01)

(52) U.S. Cl.
USPC ..... 439/532

(58) Field of Classification Search
USPC ..... 439/532
See application file for complete search history.

(56) References Cited

U.S. PATENT DOCUMENTS

| | | | | |
|---|---|---|---|---|
| 4,473,268 | A * | 9/1984 | Watanabe | 439/483 |
| 5,328,392 | A * | 7/1994 | Lin et al. | 439/833 |
| 6,650,222 | B2 * | 11/2003 | Darr et al. | 337/187 |
| 6,696,969 | B2 | 2/2004 | Torrez et al. | |
| 6,784,783 | B2 | 8/2004 | Scoggin et al. | |
| 2011/0300754 | A1 * | 12/2011 | Kim et al. | 439/620.21 |

FOREIGN PATENT DOCUMENTS

GB 2 026 784 A * 7/1978

* cited by examiner

*Primary Examiner* — Jean F Duverne
(74) *Attorney, Agent, or Firm* — Armstrong Teasdale LLP

(57) ABSTRACT

A fuse holder includes a two piece base assembly allowing assembly and attachment of fuse clips and terminals without separately provided, external fasteners such as screws. Fuse rejection features may be built-in to the base assembly adjacent one of the fuse clips.

31 Claims, 3 Drawing Sheets

MODULAR OPEN FUSE HOLDER

BACKGROUND OF THE INVENTION

The field of the invention relates generally to fuse holders or fuse blocks, and more specifically to modular fuse blocks adaptable for use with overcurrent protection fuses having opposed, axially extending terminal elements.

Electrical fuses are overcurrent protection devices for electrical circuitry, and are widely used to protect electrical power systems and prevent damage to circuitry and associated components when specified circuit conditions occur. A fusible element or assembly is coupled between terminal elements of the electrical fuse, and when specified current conditions occur, the fusible element or assembly melts or otherwise structurally fails and opens a current path between the fuse terminals. Line side circuitry may therefore be electrically isolated from load side circuitry through the fuse, preventing possible damage to load side circuitry from overcurrent conditions.

A considerable variety of overcurrent protection fuses are known and have been used to some extent with a corresponding variety of fuse holders. Improvements are, however, desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
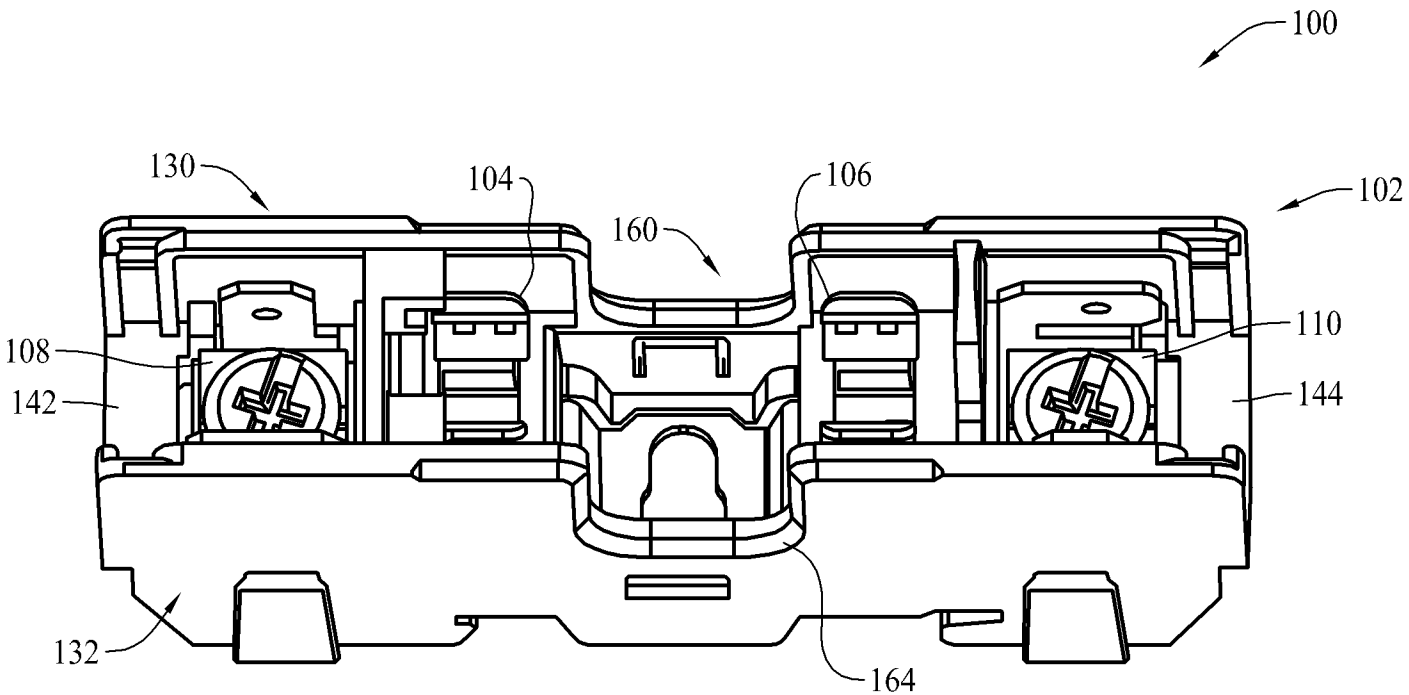
FIG. 1 is a top perspective view of an exemplary modular fuse holder.

Fuse holders present certain manufacturing difficulties that heretofore remain unaddressed in the art. In order to understand the inventive concepts disclosed herein to their fullest extent, some discussion of the state of the art is warranted.

Open style fuse holders are known to include a single piece, nonconductive base piece, typically fabricated from plastic, that is fitted with fuse clips and connection terminals for establishing electrical connection to an overcurrent protection fuse. The fuse clips and/or connection terminals are typically fastened to the base with screws. The connection terminals facilitate electrical connections to line and load side circuitry, and the fuse clips facilitate electrical connections through the terminal elements of the fuse and the fuse element or fusible assembly extending between the fuse terminal elements at a location internal to the body of the fuse.

The fuse clips are constructed to resiliently receive terminal elements of the electrical fuse, such as ferrules or blade-type contacts that extend from opposing axial ends of the fuse body. The terminal elements of an electrical fuse can be inserted into and removed from the fuse clips of the fuse holder while the line side and load side connections remain in place. Because of their convenience, such fuse holders are in common use, both separately and in combination with other fuse holders to established fused electrical connections.

Conventional fuse holders are problematic from a manufacturing perspective. The assembly of the terminal elements to the base with screws, snaps or other mechanical couplers is not easily accomplished in an automated manner, if at all. When assembled by hand, the proper installation of the terminal elements can sometimes be challenging. It would be desirable to provide a fuse holder that is simpler and more amenable to automated assembly at a lower cost.

Further, the fabrication of the fuse clips and terminal elements tends to dominate the overall costs of providing fuse holders. In certain cases wherein fuse rejection features are desirable to avoid installation of an incompatible fuse, such rejection features are often built into the fuse clips at increased cost. Because of the increased costs of the fuse clips with built-in fuse rejection features, two types of fuse clips are sometimes utilized in fuse holders, one with a rejection feature and one without. This means, however, that a fuse holder manufacturer generally must build and maintain an inventory of each type of fuse clip. When assembled by hand, this presents a possibility of human error in installing the wrong type of clip on one side or the other of the fuse holder. It would be desirable to reduce the costs of manufacturing the fuse clips, eliminate inventories of different types of fuse clips, and simplify assembly issues of installing the clips to the fuse holders.

It has been proposed to add further components to the base to provide fuse rejection features. Such components may be fabricated from metal or plastic, but tend to increase, rather than decrease, the complexity of the fuse holders and associated cost to manufacture.

Exemplary embodiments of fuse holders are described below that address and overcome at least the problems discussed above. Method aspects of the inventive concepts will be in part apparent and in part explicitly discussed in the following description.

FIG. 1 is a top perspective view of an exemplary modular fuse holder 100 including a base assembly 102 and fuse clips 104, 106 coupled to the base assembly. Connection terminals 108, 110 are also provided, and in the exemplary embodiment shown the connection terminals 108, 110 are integrally formed with the fuse clips 104, 106. The connection terminals define termination structure to establish line side and load side electrical connections to electrical circuitry of an electrical power system. The fuse clips 104, 106 are constructed to resiliently receive and engage terminal elements of an overcurrent protection fuse 120.

The fuse 120 in the exemplary embodiment shown includes a generally cylindrical fuse body 122 fabricated from a nonconductive material and conductive terminal elements 124, 126 attached to the opposing ends of the body 122. The body 122 may be fabricated from a suitable nonconductive material known in the art according to known processes. The terminal elements 124, 126 may be provided in the form of conductive ferrules as shown. The ferrules 124, 126 may be attached to the body 122 in any known manner. The ferrule 126 of the exemplary fuse 120 may further include a projection 128 as shown extending axially outwardly from the end of the ferrule 126 and having a relatively smaller diameter than the ferrule 126. Those in the art may accordingly recognize that the fuse 120 is a class CC fuse available from Cooper Bussmann of St. Louis, Mo., among others.

One or more fusible links or elements (not shown), or a fuse element assembly, is contained within the body 122 and connected between the fuse terminal elements 124, 126 so that when electrical current through the fuse 120 exceeds a predetermined limit, the fusible elements melt and open the circuit path through the fuse 120.

As such, when the fuse 120 is installed in the fuse holder assembly 100, the fusible element or elements that extend between the fuse terminals 124, 126 define a conductive current path for current to flow between the fuse clips 104, 106, and in turn completes a circuit path between the line and load side connection terminals 108, 110. When the fusible element or elements operate in response to specified current conditions, however, no current is conducted between the fuse terminal elements 126, 128 and the line side terminal 108 becomes electrically isolated from the load side terminal 110. The fuse 120 must then be replaced to restore operation of the circuitry.

It is important that the fuse 120 not be replaced with another and generally incompatible type of fuse. Because different types of fuses, however, can be relatively easily confused this presents practical concerns to power system administrators because installation of an incompatible fuse can either compromise the overcurrent protection of the electrical system or lead to sub-optimal operation of the power system. The consequences of having a mismatched fuse installed in the fuse holder 100 can be significant. Accordingly, the assembly 100 includes rejection features to prevent this from happening. Notably, however, rejection features are not provided in fuse clips 104, 106 nor are they provided via separately provided components that need to be assembled to the fuse clips 104, 106 or the base assembly 102. Rather, fuse rejection features are integrated into the base assembly 102.

Figure 2:
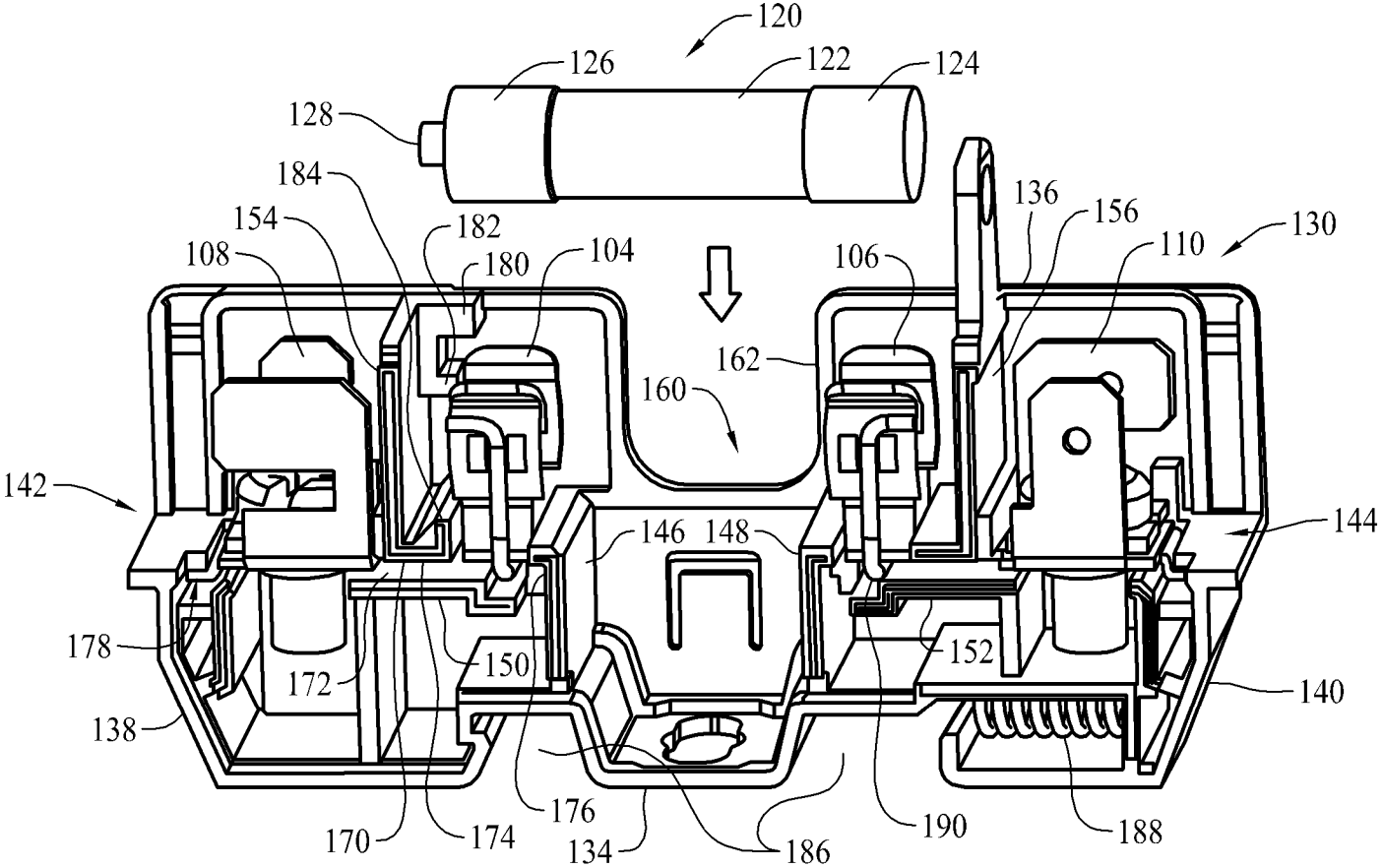
FIG. 2 is a side perspective view of the fuse holder shown in FIG. 1 with a portion removed.

The base assembly 102 includes a main base piece 130 and a cover piece 132. The main base piece 130 is shown in FIG. 2 with the cover piece 132 removed. The two-piece base construction is advantageous in a number of aspects.

The main base piece 130 includes a bottom wall 134, a lateral wall 136 extending upwardly therefrom, and end walls 138, 140 interconnecting the bottom wall 134 and the side lateral wall 136. The end walls 138, 140 extend only partially relative to the lateral wall 136 such that openings 142, 144 are provided to facilitate electrical connections to the line and load side connection terminals 108, 110. A number of interior partition walls 146, 148, 150, 152 are integrally formed in the main base piece 130 that define compartments or receptacles in the interior of the main base piece 130. The compartments or receptacles defined by the walls 146, 148, 150, 152 provide pre-defined spaces for assembly of the fuse clips 104, 106 and their respective connection terminals 108, 110, provide structural strength to the completed base assembly 102 and/or provide electrical isolation in the base assembly via air-filled spaces.

Also, barrier walls 154, 156 are formed proximate the fuse clips 104, 106. The barrier walls 154, 156 are formed integrally with the main base piece 132 and thus serve as non-conductive walls separating the conductive fuse clips 104, 106 from the connection terminals 108, 110. The barrier walls 154, 156 and the lateral wall 136 generally define an open top fuse receptacle 160 in which the fuse 120 may be inserted for installation. When so installed, the fuse body 122 generally extends across and between the fuse clips 104, 106 in the receptacle 160 with the fuse terminal elements 124, 126 secured to the fuse clips 104, 106. As such, the entirety of the fuse 120 extends between the barrier walls 154, 156 in the fuse receptacle 160. The lateral wall 136 of the main base piece 130, and also the cover piece 132, includes a respective central cutout or opening 162, 164 at the upper periphery thereof that allows access to the body 122 of the fuse 120, either with a person's fingers or a tool, to facilitate installation or extraction of the fuse 120.

The main base piece 130 is not only fabricated to be open-ended from the top as shown to provide access to the fuse clips 104, 106 and connection terminals 108, 110, but also is open from the side opposite the lateral wall 136. This provides further advantages.

In the example shown, the fuse clip 104 is formed integrally with the connection terminal 108 and includes a generally flat bridge section 170 extending therebetween. The bridge section 170 may be received in a slot 172 extending between the spaced apart partition wall 150 and a parallel lower wall 174 extending horizontally form the barrier wall 154 at the bottom of the fuse receptacle 160. A distal end 176 of the fuse clip 104 may further be supported in a second slot similarly defined in the main base piece 130, and the distal end 178 of the connection terminal 108 may also be supported in a third slot defined in the main base piece. As such, the terminal structure, including the fuse clip 104 and the connection terminal 108 are supported on the distal ends 176, 178 and also in the middle at the bridge section 170. This support by the main base piece 130, which may be fabricated from relatively rigid and sturdy plastic, allows the terminal structure (including the fuse clip 104 and the connection terminal 108) to be fabricated from a thinner and less expensive conductive material than would otherwise be necessary.

The fuse clip 106 and connection terminal 110 are similarly received in and supported by the main base piece 130 in a similar manner to that described above. The clips 104, 106 and their connection terminals 108, 110 may be slidably assembled to the main base piece 130 with relative ease. Because the ends and middle of the terminal structures are captured in the respective slots in the main base piece 130, no external or separately provided fasteners (e.g., screws) are needed to mount the terminal structures. Aside from eliminating the cost of such fasteners (e.g., screws), a much simpler assembly results that is amenable to automated manufacturing processes.

When the cover piece 132 is attached to the main base piece 130, it encloses the open compartments in the main base piece 130 and serves as another lateral wall opposing the lateral wall 136 of the main base piece. In other words, the cover piece 132 closes the base assembly from the lateral or side direction, and partially defines the open top of the base assembly 102 and forms one side of the fuse receptacle. Attachment of the cover piece 132 thus firmly captures the terminal structures in a predetermined position in the base assembly 102. It is contemplated that assembly slots and/or other supporting features could be integrated in the cover piece 132 as well as the main base piece 130 if desired.

In various embodiments, the cover piece 132 may be attached to the main base piece 130 after the terminal structures are installed to complete the base assembly 102 and the overall fuse holder 100 in a variety of ways. For example, the cover piece 132 may be ultrasonically welded to the main base piece 102. Alternatively, mechanical fasteners such as screws, rivets, snaps, heat stakes could be utilized to couple the cover piece 132 to the main base piece 130. Still further, adhesives and the like may be utilized to join the pieces 132 and 130. Still other variations and alternatives are, of course possible.

As a further benefit, and because of the construction of the base assembly 102, the fuse clips 104, 106 may be identically constructed but mounted in a reversed or mirror-image arrangement adjacent on either side of the fuse receptacle 160. This is possible because fuse rejection features are provided in the base assembly 102, and thus any need for two types of fuse clips (one configured to reject the fuses and the other not), common to conventional fuse holders, is eliminated. The greater expense of fuse rejecting clips is eliminated entirely, and inventory expenses for stocking different types of fuse clips is avoided and provides further manufacturing savings.

As shown in FIG. 2, fuse rejection features are built into the barrier wall 154 and the fuse receptacle 160 adjacent the terminal 104. In the example shown, a three stage fuse rejection feature is shown and includes a first horizontally projecting tab 180 extending inwardly from the barrier wall 154 and projecting into the fuse receptacle 160, a second horizontally projecting tab 182 extending inwardly from the barrier wall 154 and projecting into the fuse receptacle 160, and a third vertically projecting tab 184 extending upwardly into the fuse receptacle 160 from the lower wall 174 at the bottom of the fuse receptacle 160. Each of these fuse rejection tabs 180, 182, 184 are, as shown, spaced from one another at different locations in the fuse receptacle 160 and at different locations relative to the fuse terminal 104. The horizontally extending tabs 180, 182 extend generally parallel to one another in a spaced apart relationship, but extend in unequal amounts (i.e., extend different distances from the barrier wall 154), while the third tab 184 extends perpendicularly to the tabs 180, 182 at the bottom of the receptacle 160. The tabs 180, 182, 184 are therefore located at different elevations in the receptacle 160 and provide varying degrees of interference for fuses that are incompatible with the fuse 120.

If the fuse 120 is replaced with another fuse of the same type having the projection 128 on the terminal element 126, it may be installed into the fuse holder 100 without difficulty. The reduced diameter projection 128 on the fuse terminal 126 will clear all of the rejection tabs 180, 182, and 184 and the fuse may be easily engaged with the fuse clips 104 and 106. If one attempts to insert an incompatible fuse, however, and specifically one not having the reduced diameter terminal projection 128, the larger diameter ferrule of the fuse will conflict with all three rejection tabs 180, 182, 184 and prevent the fuse from being installed. Thus, even if one attempts to avoid the rejection tab 180 by angling an incompatible fuse as it is inserted, the rejection tabs 182 or 184 will still frustrate installation of the incompatible fuse. As such, while it may be possible for a determined person to avoid one of the fuse rejection tabs, it is not possible to avoid all of them. Because of the fuse rejection tabs 180, 182, 184, only a compatible fuse can be fully engaged with the fuse clips 104, 106.

The fuse rejection tabs 180, 182, 184 may be formed in the main base piece 130 at a lower cost than either forming rejection features in one of the fuse clips or separately provided components as conventionally has been done. The base piece 130 including the fuse rejection tabs and other features described, may be fabricated using relatively low cost molding techniques. While exemplary fuse rejections features have been described, alternatives are possible for other types of fuses. It is further contemplated that fuse rejection features similar to the tabs as described could be provided on the cover piece 132 of the base assembly instead of the main base piece 130. In another contemplated embodiment, fuse rejection features could be provided partly in the main base piece 130 and partly in the cover piece 132, but cooperatively providing a similar function and effect to that described above.

Molding techniques for fabricating the base 102 provide additional versatility to fabricate the main base piece 130 to include still other desirable features at a relatively low cost. For example, the bottom wall 134 in the embodiments illustrated includes a DIN rail slot 186 for convenient mounting of the fuse holder, and easily accommodates a DIN rail spring 188 in its own compartment and a bias element 190 for the fuse clips via the configuration of the internal partition walls. In another embodiment, the slot 186 may be defined with resilient tabs that avoid any need for a separately provided bias element common to conventional DIN rail slots. Still other features could be included such as positive stops for fuse installation, local and remote fuse state indication features, current and/or voltage sensors, etc. The main base piece is highly adaptable to changes in configuration at relatively low cost.

Figure 3:
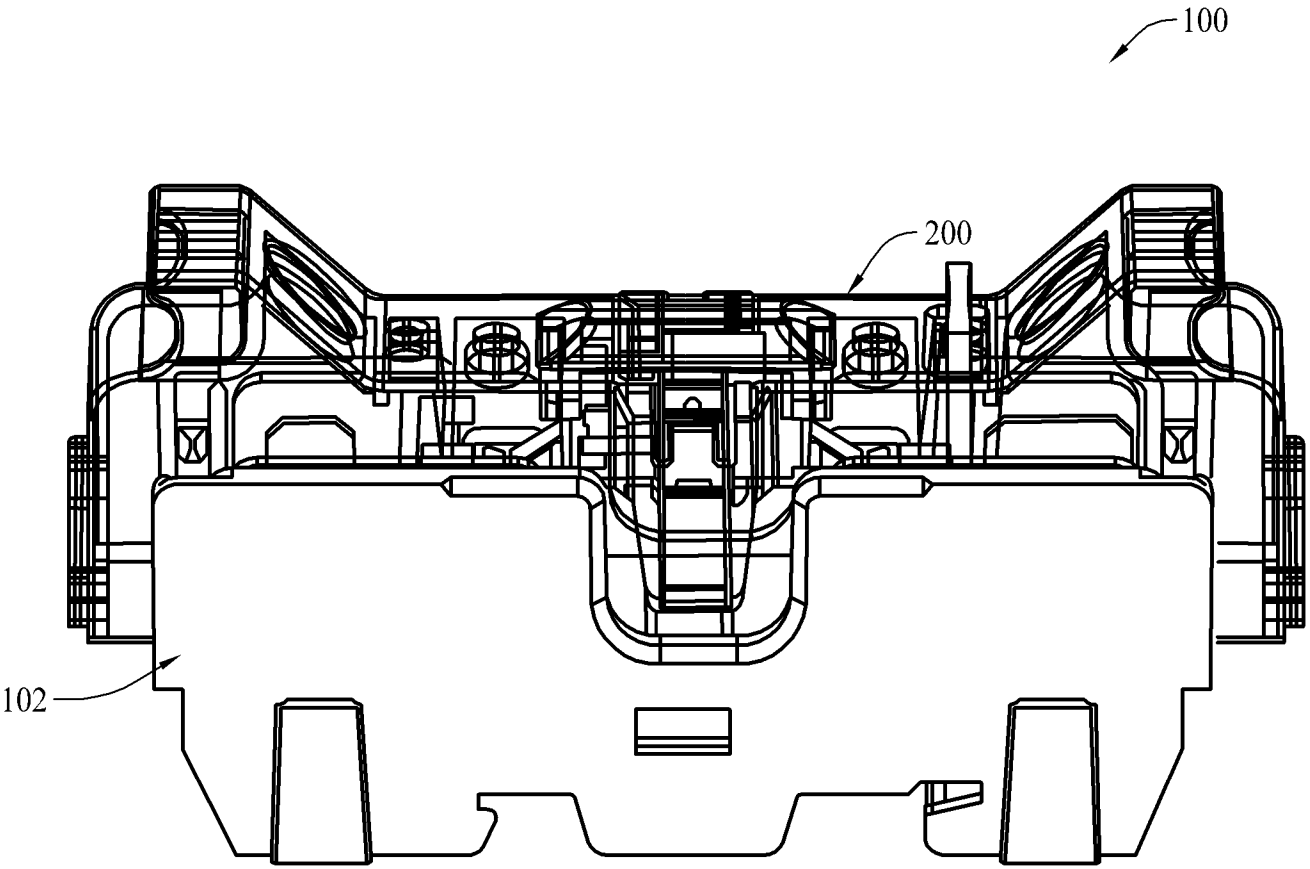
FIG. 3 is a top perspective view of the fuse holder shown in FIG. 1 with a fuse cover installed.

FIG. 3 shows an exemplary fuse cover 200 mounted to the base assembly 102. The cover 200 may be fabricated from a translucent or transparent material, as opposed to an opaque material, allowing the fuse 120 to be visually inspected without opening the cover 200. The cover 200 may further be provided with indicating features if desired, signal connectors for remote communication purposes, or other features known in the art. The cover 200 may be fabricated from known materials using known techniques, and while an exemplary cover 200 is shown having a specific shape, various alternative shapes, geometries and dimensions of covers may alternatively be provided.

Additionally, the lateral sides of the base assembly 102 may be provided as shown with tongues or grooves allowing adjacent fuse holders 100 to be mechanically coupled to ganged together to form a multi-pole fuse block. Alternatively, more than one pair of fuse clips and connecting terminals may be provided in the base assembly 102 to provide a multiple pole fuse holder or fuse block. Various adaptations are possible.

The fuse clips 104, 106 and connection terminals 108, 110 are exemplary only. Other types of fuse clips, including but not limited to fuse clips constructed to engage axially extending blade contacts on opposing ends of the fuse body, sometimes referred to as knife-blade contacts may alternatively be utilized. Likewise, a variety of connection terminals are known in the art and may be utilized in lieu of the specific terminals 108, 110 shown in the Figures.

The benefits and advantages of the inventive concepts disclosed are now believed to be evident from and amply illustrated in the exemplary embodiments disclosed.

An embodiment of a fuse holder has been disclosed including: a nonconductive base assembly; and first and second conductive fuse clips coupled to the base assembly in a spaced apart relation to receive and engage terminal elements of a cylindrical overcurrent protection fuse; wherein the base assembly comprises a main base piece and a cover piece coupled to the main base piece; wherein at least the main base piece defines at least one retaining slot configured to receive and retain each of the first and second fuse clips without separately provided mechanical fasteners.

Optionally, the cover piece may be attachable to the main base piece after the first and second fuse clips have been retained. The cover piece may be ultrasonically welded to the main base piece. The main base piece may be integrally formed with at least a first fuse rejection feature, and may also be integrally formed with at least a second fuse rejection feature, the second fuse rejection feature being spaced from the first fuse rejection feature. The main base piece may further be integrally formed with at least a third fuse rejection feature, the third fuse rejection feature being spaced from the first fuse rejection feature. The main base piece may be formed with a DIN rail slot.

The first and second fuse clips may be substantially identically constructed, and the first and second fuse clips each include: a fuse clip section; a connection terminal section; and a bridge section connecting the fuse clip section and the connection terminal. At least the bridge section may be received in the at least one retaining slot. The main base piece may define a barrier wall separating the fuse clip section from the connection terminal section. A fuse cover may be mounted to the base assembly.

An embodiment of a fuse holder has also been disclosed including: a nonconductive base assembly; and first and second conductive fuse clips coupled to the base assembly; wherein the base assembly comprises a main base piece and a cover piece coupled to the main base piece; wherein the base assembly defines a plurality of fuse rejection tabs spaced from one another.

Optionally, the main base piece may define at least one retaining slot configured to receive and retain each of the first and second fuse clips without separately provided mechanical fasteners. The cover piece may be attachable to the main base piece after the first and second fuse clips have been retained. The cover piece may be ultrasonically welded to the main base piece. A plurality of fuse rejection tabs may be located proximate one of the first and second conductive fuse clips. The main base piece may include an upper edge and a lower edge, and the plurality of fuse rejection tabs may be spaced at different elevations between the upper and lower edges. The plurality of fuse rejection tabs may include a first tab extending in a first direction and a second tab extending a second direction. The second direction may be perpendicular to the first direction. The plurality of fuse rejection tabs may include a first tab, a second tab, and a third tab each respectively extending proximate one of the first and second fuse clips. The main base piece may be formed with a DIN rail slot. The first and second fuse clips may be substantially identically constructed, and the first and second fuse clips may each comprise: a fuse clip section; a connection terminal section; and a bridge section connecting the fuse clip section and the connection terminal. At least the bridge section may be received in the at least one retaining slot. The main base piece may define a barrier wall separating the fuse clip section from the connection terminal section. A fuse cover may be mounted to the base assembly.

Another embodiment of a fuse holder has been disclosed including: a nonconductive base assembly; and first and second conductive fuse clips coupled to the base assembly, each of the first and second conductive fuse clips being substantially identically constructed to one another; wherein the base assembly comprises a main base piece and a cover piece coupled to the main base piece; wherein the main base piece defines at least one retaining slot configured to receive and retain each of the first and second fuse clips without separately provided mechanical fasteners; and wherein the main base piece further defines a plurality of fuse rejection tabs spaced from one another.

Optionally, the cover piece may be attachable to the main base piece after the first and second fuse clips have been retained. The cover piece may be ultrasonically welded to the main base piece. The main base piece may be formed with a DIN rail slot. A fuse cover may be mounted to the base assembly.

Still another embodiment of a fuse holder has been disclosed including: a nonconductive base assembly comprising a main base piece and a cover piece coupled to the main base piece; and first and second conductive fuse clips coupled to the base assembly, each of the first and second conductive fuse clips being substantially identically constructed to one another; wherein the base assembly defines at least one retaining slot configured to receive and retain each of the first and second fuse clips without separately provided mechanical fasteners; and wherein the base assembly further defines a plurality of fuse rejection tabs spaced from one another.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuse holder comprising:

a nonconductive base assembly; and first and second conductive fuse clips coupled to the base assembly in a spaced apart relation to receive and engage terminal elements of a cylindrical overcurrent protection fuse;

wherein the base assembly comprises a main base piece and a cover piece coupled to the main base piece;

wherein at least the main base piece defines at least one retaining slot configured to receive and retain each of the first and second fuse clips without separately provided mechanical fasteners.

2. The fuse holder of claim 1, wherein the cover piece is attachable to the main base piece after the first and second fuse clips have been retained.

3. The fuse holder of claim 2, wherein the cover piece is ultrasonically welded to the main base piece.

4. The fuse holder of claim 1, wherein the main base piece is integrally formed with at least a first fuse rejection feature.

5. The fuse holder of claim 4, wherein the main base piece is further integrally formed with at least a second fuse rejection feature, the second fuse rejection feature being spaced from the first fuse rejection feature.

6. The fuse holder of claim 5, wherein the main base piece is further integrally formed with at least a third fuse rejection feature, the third fuse rejection feature being spaced from the first fuse rejection feature.

7. The fuse holder of claim 1, wherein the main base piece is formed with a DIN rail slot.

8. The fuse holder of claim 1, wherein the first and second fuse clips are substantially identically constructed.

9. The fuse holder of claim 1, wherein the first and second fuse clips each comprise:

a fuse clip section;

a connection terminal section; and a bridge section connecting the fuse clip section and the connection terminal.

10. The fuse holder of claim 9, wherein at least the bridge section is received in the at least one retaining slot.

11. The fuse holder of claim 9, wherein the main base piece defines a barrier wall separating the fuse clip section from the connection terminal section.

12. The fuse holder of claim 1, further comprising a fuse cover mounted to the base assembly.

13. A fuse holder comprising:

a nonconductive base assembly; and first and second conductive fuse clips coupled to the base assembly;

wherein the base assembly comprises a main base piece and a cover piece coupled to the main base piece;

wherein the base assembly defines a plurality of fuse rejection tabs spaced from one another;

wherein the plurality of fuse rejection tabs includes a first tab extending in a first direction and a second tab extending a second direction; wherein the second direction is perpendicular to the first direction.

14. The fuse holder of claim 13, wherein the main base piece defines at least one retaining slot configured to receive and retain each of the first and second fuse clips without separately provided mechanical fasteners.

15. The fuse holder of claim 13, wherein the cover piece is attachable to the main base piece after the first and second fuse clips have been retained.

16. The fuse holder of claim 14, wherein the cover piece is ultrasonically welded to the main base piece.

17. The fuse holder of claim 13, wherein a plurality of fuse rejection tabs are located proximate one of the first and second conductive fuse clips.

18. The fuse holder of claim 13, wherein the main base piece includes an upper edge and a lower edge, and the plurality of fuse rejection tabs are spaced at different elevations between the upper and lower edges.

19. The fuse holder of claim 13, wherein the wherein the plurality of fuse rejection tabs includes a first tab, a second tab, and a third tab each respectively extending proximate one of the first and second fuse clips.

20. The fuse holder of claim 13, wherein the main base piece is formed with a DIN rail slot.

21. The fuse holder of claim 13, wherein the first and second fuse clips are substantially identically constructed.

22. The fuse holder of claim 13, wherein the first and second fuse clips each comprise:

a fuse clip section;

a connection terminal section; and a bridge section connecting the fuse clip section and the connection terminal.

23. The fuse holder of claim 22, wherein at least the bridge section is received in the at least one retaining slot.

24. The fuse holder of claim 22, wherein the main base piece defines a barrier wall separating the fuse clip section from the connection terminal section.

25. The fuse holder of claim 13, further comprising a fuse cover mounted to the base assembly.

26. A fuse holder comprising:

a nonconductive base assembly; and first and second conductive fuse clips coupled to the base assembly, each of the first and second conductive fuse clips being substantially identically constructed to one another;

wherein the base assembly comprises a main base piece and a cover piece coupled to the main base piece;

wherein the main base piece defines at least one retaining slot configured to receive and retain each of the first and second fuse clips without separately provided mechanical fasteners; and wherein the main base piece further defines a plurality of fuse rejection tabs spaced from one another;

wherein the plurality of fuse rejection tabs includes a first tab extending in a first direction and a second tab extending a second direction; wherein the second direction is perpendicular to the first direction.

27. The fuse holder of claim 26, wherein the cover piece is attachable to the main base piece after the first and second fuse clips have been retained.

28. The fuse holder of claim 27, wherein the cover piece is ultrasonically welded to the main base piece.

29. The fuse holder of claim 26, wherein the main base piece is formed with a DIN rail slot.

30. The fuse holder of claim 26, further comprising a fuse cover mounted to the base assembly.

31. A fuse holder comprising:

a nonconductive base assembly comprising a main base piece and a cover piece coupled to the main base piece; and first and second conductive fuse clips coupled to the base assembly, each of the first and second conductive fuse clips being substantially identically constructed to one another;

wherein the base assembly defines at least one retaining slot configured to receive and retain each of the first and second fuse clips without separately provided mechanical fasteners; and wherein the base assembly further defines a plurality of fuse rejection tabs spaced from one another;

wherein the plurality of fuse rejection tabs includes a first tab extending in a first direction and a second tab extending a second direction; wherein the second direction is perpendicular to the first direction.

* * * * *